US007413111B2

(12) United States Patent
Quaintance et al.

(10) Patent No.: US 7,413,111 B2
(45) Date of Patent: Aug. 19, 2008

(54) PAPERBOARD CONTAINER WITH BOTTOM SUPPORT

(75) Inventors: Benjamin W. Quaintance, Germantown, TN (US); Brian D. Smith, Visalia, CA (US)

(73) Assignee: International Paper Company, Memphis, TN (US)

( * ) Notice: Subject to any disclaimer, the term of this patent is extended or adjusted under 35 U.S.C. 154(b) by 618 days.

(21) Appl. No.: 10/867,576

(22) Filed: Jun. 14, 2004

(65) Prior Publication Data

US 2005/0061863 A1 Mar. 24, 2005

Related U.S. Application Data

(63) Continuation-in-part of application No. 10/369,041, filed on Feb. 18, 2003, now Pat. No. 6,749,108.

(60) Provisional application No. 60/394,754, filed on Jul. 10, 2002, provisional application No. 60/357,488, filed on Feb. 15, 2002.

(51) Int. Cl.
*B65D 5/44* (2006.01)
*B65D 21/032* (2006.01)

(52) U.S. Cl. ..... 229/199; 220/651; 220/653; 229/199.1

(58) Field of Classification Search ..... 229/120.07, 229/120.33, 120.34, 199, 199.1, 915, 919; 220/651, 652, 653, 529, 532, 553
See application file for complete search history.

(56) References Cited

U.S. PATENT DOCUMENTS 1,657,515 A 1/1928 Miller
1,664,308 A 3/1928 Miller
1,706,804 A 3/1929 Miller
1,754,183 A 4/1930 Wildberg
1,755,688 A * 4/1930 Benoit ..... 229/199
1,876,063 A 9/1932 Kronenberger
1,940,010 A 12/1933 Murray
1,973,930 A 9/1934 Rammer
1,974,959 A * 9/1934 Hornecker et al. ..... 229/120.34
2,014,695 A 9/1935 Peterson
2,122,654 A 7/1938 Nickerson
2,200,867 A 5/1940 Weltmer
2,250,746 A 7/1941 Burr
2,253,428 A 8/1941 Henderson (Continued)

FOREIGN PATENT DOCUMENTS

DE 3601583 A1 * 8/1986

*Primary Examiner*—Gary E Elkins
(74) *Attorney, Agent, or Firm*—Thomas W. Barnes, III; Daniel C. Stelter; Dennis H. Lambert

(57) ABSTRACT

A container (21) for storing and shipping produce is reinforced with at least one cross beam (20) extending across the bottom wall (26) of the container to form a bridge under loose product placed in the container to support at least a portion of the weight of the product and prevent sagging of the container bottom. The cross beam is positioned and held in place by engaging the ends of the cross beam in recesses (71) formed by crushed areas (82) on an inner surface of opposing side walls, or cut-outs (93) in the side walls, and/or by flaps (42, 43) folded upwardly from the container bottom wall and to which the cross beam is attached.

34 Claims, 8 Drawing Sheets

U.S. PATENT DOCUMENTS 2,367,491 A 1/1945 Ferguson
2,483,481 A 10/1949 Stetson
2,658,253 A * 11/1953 Richardson ..... 220/651
2,759,619 A 8/1956 Barbour
2,844,299 A 7/1958 Kessier et al.
2,969,170 A 1/1961 Waldorf
3,097,781 A 7/1963 Masi
3,101,881 A 8/1963 Crane
3,107,041 A 10/1963 Wagner, Jr.
3,159,326 A 12/1964 Stonebanks
3,493,101 A 2/1970 Collin
3,519,190 A 7/1970 Achermann et al.
3,536,246 A 10/1970 Rosen
3,764,059 A * 10/1973 Knowles ..... 229/199
3,800,960 A 4/1974 Collin
3,910,411 A 10/1975 Deeren
3,934,790 A 1/1976 Easter
3,946,935 A 3/1976 Bonczyk
3,993,239 A 11/1976 Exel
4,081,124 A 3/1978 Hall
4,160,519 A 7/1979 Gorham
4,227,640 A * 10/1980 Roccaforte ..... 229/104
4,293,076 A 10/1981 Collin
4,341,338 A 7/1982 Arnold
4,498,584 A 2/1985 Newbury
4,663,207 A 5/1987 Kupersmit
4,757,938 A 7/1988 Collins
4,828,894 A 5/1989 Taylor
4,948,033 A 8/1990 Halsell, II et al.
4,984,690 A 1/1991 King et al.
5,143,283 A 9/1992 Lancaster
5,261,594 A 11/1993 Brown et al.
5,285,956 A 2/1994 Piepho
5,372,299 A 12/1994 Edgerton, Jr. et al.
5,450,998 A 9/1995 Esse et al.
5,538,130 A 7/1996 Harrelson
5,638,983 A 6/1997 Bazany
5,649,663 A * 7/1997 Pestow, Jr. ..... 229/190
5,687,902 A 11/1997 Tusing et al.
5,749,513 A * 5/1998 Strauser ..... 229/199
5,871,148 A 2/1999 Hafer et al.
5,988,492 A 11/1999 Capy et al.
6,062,469 A 5/2000 Hafer et al.
6,092,718 A * 7/2000 Chen et al. ..... 229/120.34
6,129,267 A 10/2000 Hafer et al.
6,138,904 A 10/2000 Baird et al.
6,687,902 B1 2/2004 Curtis et al.
6,749,108 B2 * 6/2004 Naughton et al. ..... 229/199
7,207,473 B2 * 4/2007 Fry ..... 229/174
2003/0173396 A1 9/2003 Naughton et al.
2005/0061863 A1 3/2005 Quaintance et al.

* cited by examiner

PAPERBOARD CONTAINER WITH BOTTOM SUPPORT

RELATED APPLICATIONS

This application is a continuation-in-part of U.S. application Ser. No. 10/369,041, filed Feb. 18, 2003, which claims the benefit of provisional application Ser. No. 60/394,754, filed Jul. 10, 2002, and provisional application Ser. No. 60/357,488, filed Feb. 15, 2002, all of which are hereby incorporated by reference in their entirety.

TECHNICAL FIELD

This invention relates to packaging, and more particularly to a reinforced container erected from a paperboard blank for holding, stacking and transporting items such as agricultural produce. In particular, the present invention relates to a reinforced container having a beam or other rigid structure extending between opposite side or end walls transversely across the container adjacent the container bottom to at least partially support product placed in the container and prevent sagging of the bottom.

BACKGROUND ART

Containers formed of corrugated paperboard are used in many different applications, such as, for example, to store and ship agricultural produce. These containers typically have a bottom wall, opposite side walls, and opposite end walls, and are formed from a blank of corrugated paperboard scored with score lines or cut lines. The paperboard blank is folded along the score lines or cut lines to form a container, and may be folded into the container by an automated machine, or the consumer may erect them manually. A removable top may be placed on the container, although it is not required.

Containers made of corrugated paperboard usually are recyclable, and generally are less expensive than containers made of wood, metal or plastic, but they must have sufficient strength to withstand the stresses imposed on them by vertical stacking, and the wear and tear of shipping and handling, particularly to avoid damage to the contained product. Thus, paperboard containers are sometimes reinforced with additional structures. Other reinforcement structures may take the form of beams or ridges that are integrally formed in the side or bottom walls, or in an interior lining of the container. These supports, however, limit the interior space of the container and require excessive amounts of additional material.

Other reinforced containers have beams or other rigid structures that extend over an upper portion or top of the container. This type of reinforcement is more commonly used in containers that are especially short and wide, and/or have a removable cover, wherein the removable cover bears an undue amount of stress. However, these types of reinforcements are often bonded to the cover and do not come in significant contact with the side walls, lessening the strength of the reinforcement system.

Further, agricultural produce normally is packed in shipping containers in a cool damp environment, and tends to pool in the bottom of the container, causing the container bottom to sag. This sag tends to transfer from one container to another when the containers are stacked on top of one another for storage and handling. Top reinforcements tend to obscure or impair the visibility of the product contained in the container unless they are removable.

Therefore, it is an object of this invention to provide a paperboard container with a reinforcement structure that at least partially supports the product held in the container to prevent sagging of the container bottom, and that does not unduly restrict the interior volume of the container, or impair the visibility of the product.

DISCLOSURE OF THE INVENTION

The present invention comprises a container having a reinforcing cross beam or other rigid structure that extends across a bottom portion of the container and is operative to at least partially support product held in the container to prevent sagging of the container bottom.

The container may be any corrugated container of the type often used for storing and transporting products, and especially food items, with a bottom wall, two opposing side walls, two opposing end walls, and in some cases a removable cover or lid. The cross beam or other rigid structure preferably is held in position by cooperating structure on the container bottom and/or walls.

In one embodiment, the cooperating structure comprises recesses formed by crushed areas in two opposing walls, and opposite ends of the beam extend into the recessed areas to hold the beam in place. In another embodiment, die cut portions are removed from two opposing walls to form the recessed areas. In a preferred embodiment, flaps are cut from the bottom wall and folded upwardly into the container interior, and the cross beam is secured to the underside of the flaps by use of an adhesive or other suitable fastening means.

Multiple recesses may be formed in the container side walls, or multiple flaps may be cut from the bottom wall, to accommodate more than one cross beam.

The cross beam may be constructed of any suitably rigid material such as wood, corrugated paper, paper wound posts, plastic, metal or a composite material.

The beam or other rigid structure may have various shapes and sizes to maximize the performance of the beam and minimize intrusion into the interior space of the container. In one embodiment, the beam is substantially circular in transverse cross-section, and in another embodiment it has rounded or straight edges with a flattened top surface. In a preferred embodiment, the beam has a triangular shape in transverse cross-section. The preferred embodiment is particularly well adapted for use with the flaps cut from the bottom wall, wherein the flaps may be secured to opposite downwardly diverging top surfaces of the beam, with the bottom surface of the beam extending substantially flush with the bottom wall.

BRIEF DESCRIPTION OF THE DRAWINGS

Other objects and advantages of the invention will become apparent from the following detailed description and the accompanying drawings, wherein like reference characters designate like parts throughout the several views, and wherein.

DESCRIPTION OF THE PREFERRED EMBODIMENTS

Figure 1:
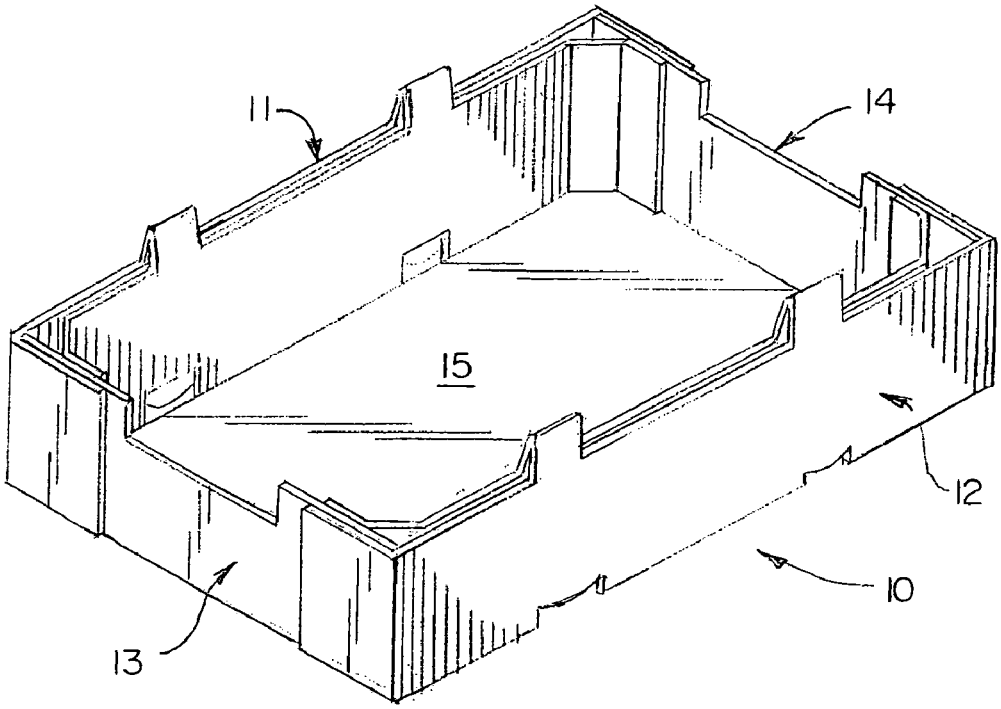
FIG. 1 (PRIOR ART)
FIG. 1 is a top perspective view of a conventional paperboard container having an unreinforced bottom.
Figure 2:
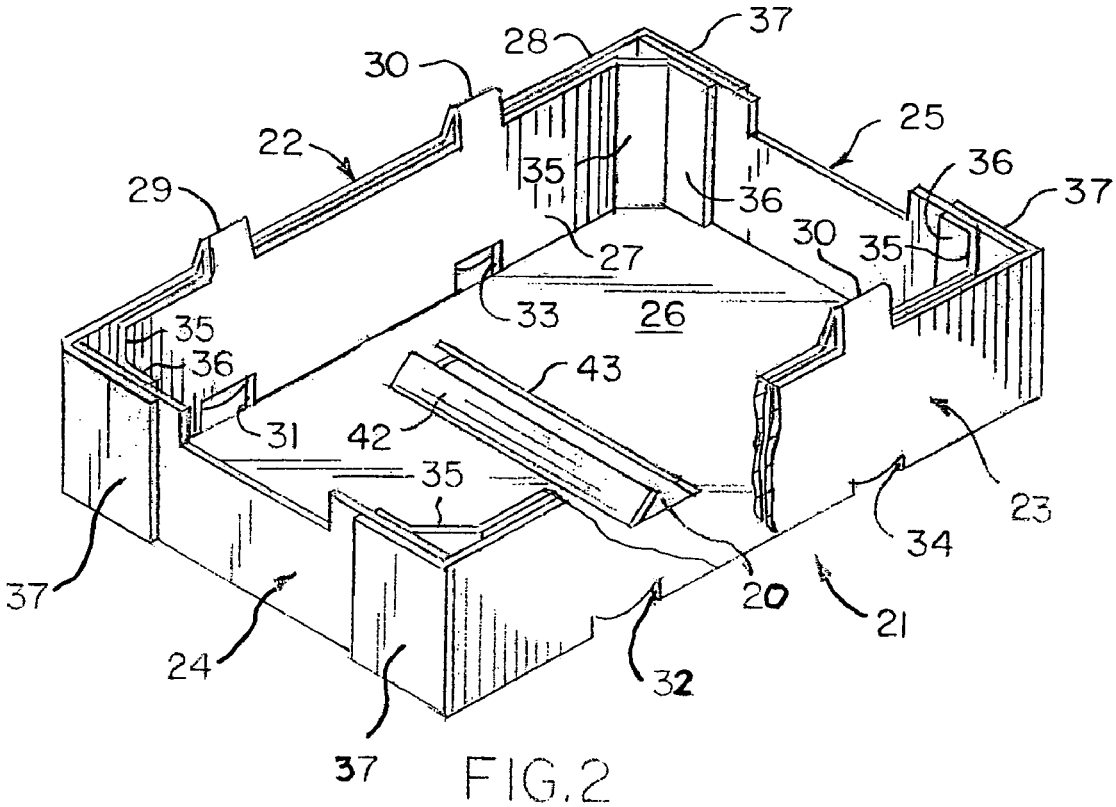
FIG. 2 is a top perspective view, with portions broken away for purposes of illustration, of a container with the bottom reinforced by a cross beam in accordance with a preferred embodiment of the invention.
Figure 3:
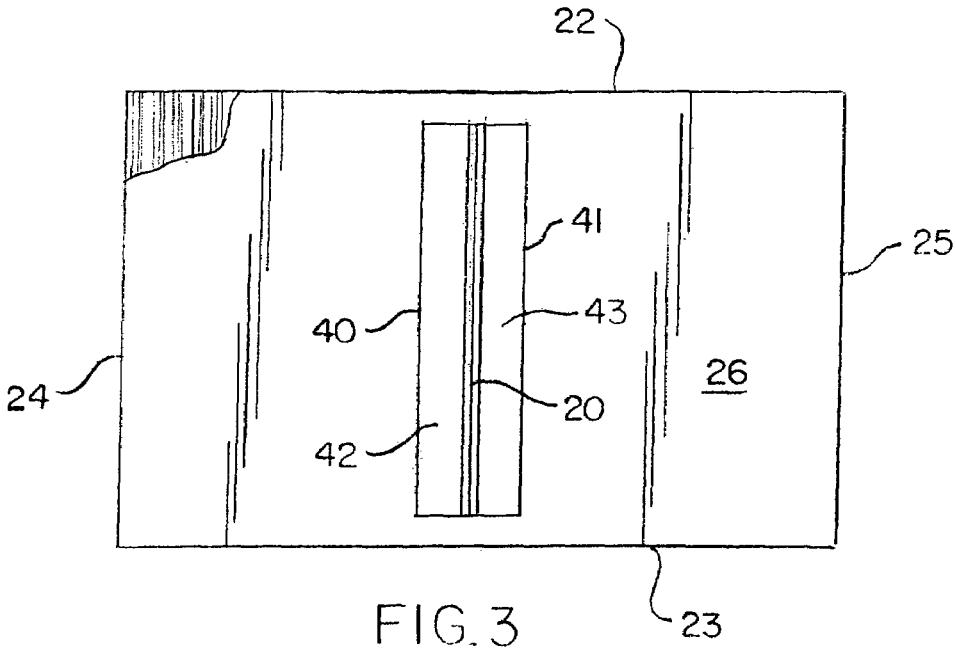
FIG. 3 is a top plan view of the container of FIG. 2.
Figure 4:
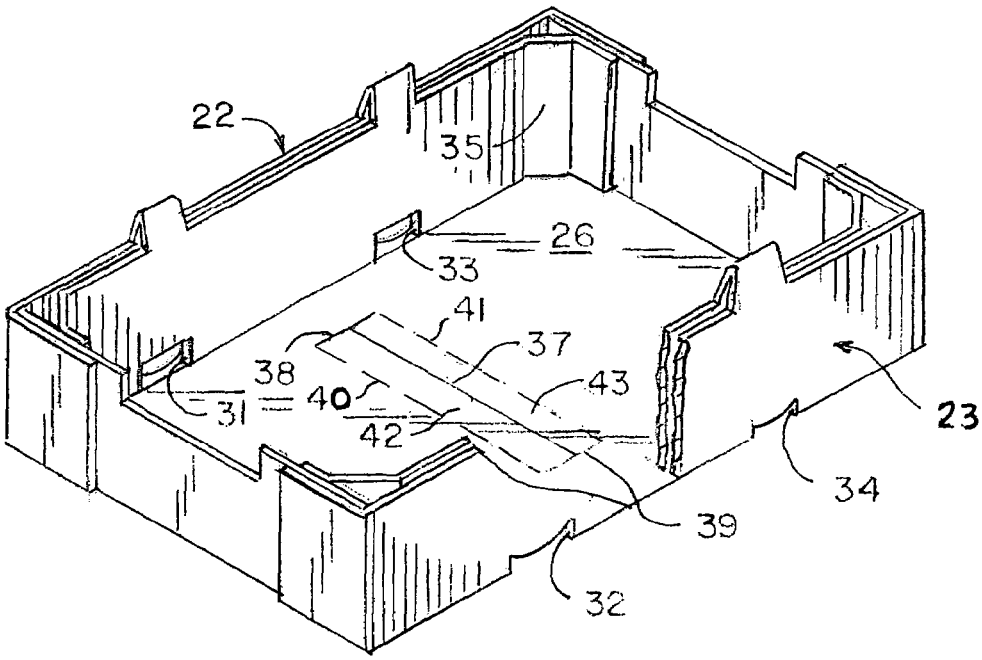
FIG. 4 is a top perspective view similar to FIG. 2, but with the reinforcing cross beam ommitted to more clearly illustrate the cuts and scores made in the bottom wall for attaching the beam.
Figure 5:
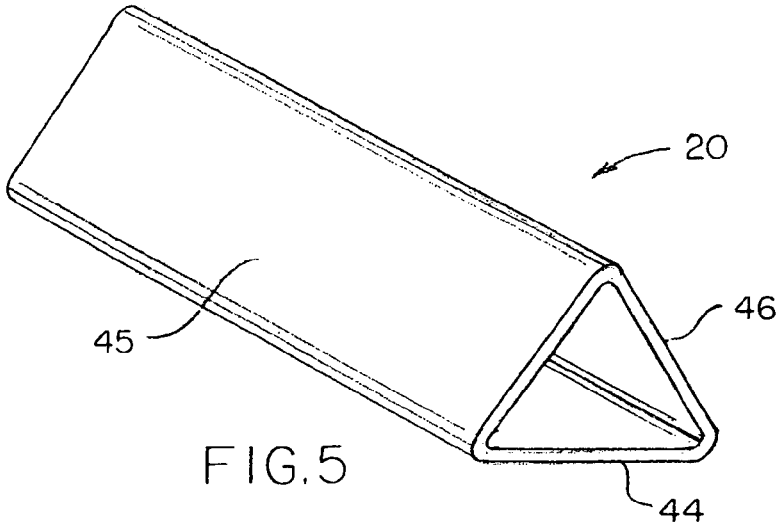
FIG. 5 is a top perspective view of one form of cross beam for use in the embodiment of FIG. 2.

The prior art corrugated paperboard container 10 shown in FIG. 1 has opposite side walls 11 and 12, opposite end walls 13 and 14, and a bottom wall 15. The bottom wall typically is of single wall construction, and the side and/or end walls may be either single wall or double wall construction, depending upon the intended use of the container and the necessary characteristics. As shown in FIG. 1, the container is depicted generically, with a simplified construction having plain side and end walls. It should be understood, however, that the container can comprise a stackable produce container style tray as shown in co-pending parent application Ser. No. 10/369,041, or any other relevant construction. When the container is used for packaging fresh produce, a stackable produce container style tray such as that depicted in parent application Ser. No. 10/369,041 often is employed. The produce normally is packed in the container in a cool damp environment, and tends to pool in the bottom of the container, causing the container bottom to sag.

The present invention solves the foregoing problem by placing a reinforcing cross beam 20 in the bottom of the container 21, as shown, for example, in the preferred embodiment of FIGS. 2-6. As shown in these figures, the container is a stackable produce container style container, although it should be understood that the invention could equally as well be applied to other containers, such as the basic container shown in FIG. 1. The cross beam forms a bridge under loose product in the container, suspending the load over the package midsection where it tends to sag the most.

The container 21 has opposite sidewalls 22 and 23, opposite end walls 24 and 25, and a bottom wall 26. The side walls in this embodiment are of double wall construction, having an inner side wall panel 27 and an outer side wall panel 28. The inner and outer side wall panels are foldably connected together at their upper edges by webs that form upstanding tabs 29 and 30 defining stacking tabs. Cut-outs 31, 32 and 33, 34 are made in the lower edges of the inner and outer side wall panels for receiving the stacking tabs when the containers are stacked on top of one another, to locate the containers in accurate vertical alignment with one another and forming an interlock between the stacked containers to insure stable stacking of the containers.

Extensions on opposite ends of the inner side wall panels 27 form diagonal corner panels 35 for increased stacking strength, and glue flaps 36 that are adhesively attached to an adjacent inner surface of the respective end walls 24 and 25 for securing the inner side wall panels in the erected position shown. Glue flaps 37 on the opposite ends of the outer side wall panels 28 are folded inwardly over the outer side edges of the end walls 25 and 25 and adhesively secured thereto, whereby the opposite side edges of the end walls are sandwiched between and adhesively secured to the extensions on the inner and outer side wall panels.

A transversely extending cut 37 (see FIG. 4) is made in the bottom wall 26, terminating at its opposite ends in substantially orthogonal cuts 38 and 29 that are spaced from and parallel to the opposite side walls 22 and 23. Scores 40 and 41 extend between the outer ends of the respective cuts 38 and 39, and with the cuts define two elongate flaps 42 and 43. However, such cuts may be non-parallel too.

The cross beam 20 can have any suitable shape and can be made from a variety of suitably rigid materials, such as, for example, fiber, plastic or corrugated paperboard material. In the FIGS. 2-6 embodiment, the beam is tubular and has a triangular shape in transverse cross-section, with a bottom panel 44 and opposite top panels 45 and 46. In use, the flaps 42 and 43 may be pushed down against the beam, which may be adhesively secured to the top panels 45 and 46 of the beam.

Figure 6:
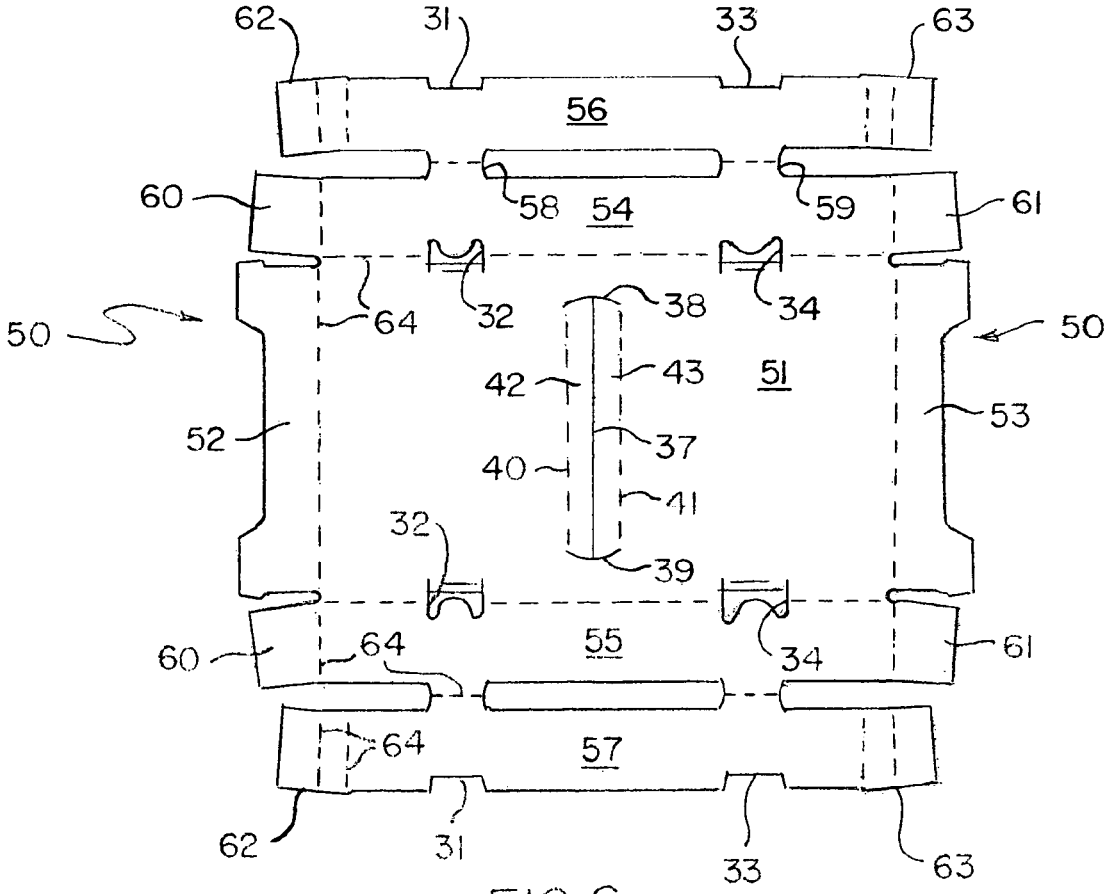
FIG. 6 is a top plan view of a blank for making the container of FIG. 2.

A blank from which the container of FIGS. 2-5 can be made is indicated generally at 50 in FIG. 6. The blank comprises an elongate, rectangularly shaped central panel 51 that forms the bottom wall 26 in the erected container, opposite end panels 52 and 53 that form the end walls 24 and 25, first side panels 54 and 55 that form the outer side wall panels 28 in the erected container, and second side panels 56 and 57, that form the inner side wall panels 27 in the erected container. The panels 54 and 55, and the panels 56 and 57, are respectively foldably connected together by webs 58 and 59 that form the stacking tabs in the erected container. Extensions 60 and 61 on opposite ends of the first side panels form the glue flaps 37 that are adhesively attached to the outer surface of the adjacent sides of the end panels in the erected container, and extensions 62 and 63 on opposite ends of the second side panels form the diagonal corner panels 35 and glue flaps 36 in the erected container. The respective panels and flaps are foldably joined to one another by suitable scores 64 between adjoining panels and flaps.

Figure 7:
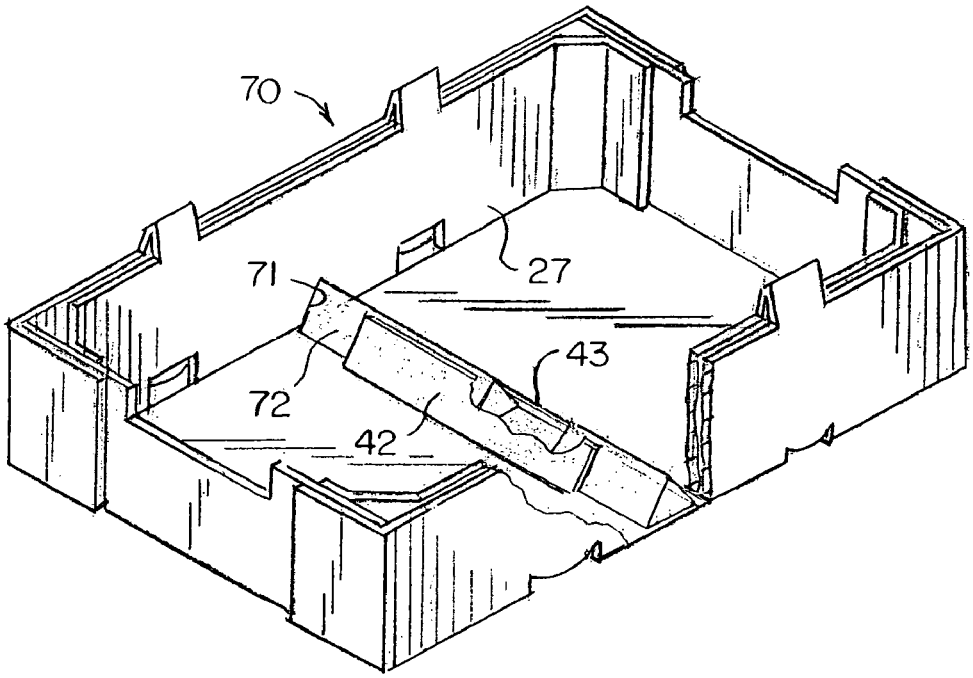
FIG. 7 is a top perspective view, with portions broken away, of a second embodiment of a container according to the invention, wherein cut-outs are formed in the inner side wall, defining recesses for receiving the opposite ends of a slightly elongated cross beam to locate it.

A second embodiment is shown at 70 in FIG. 7. This embodiment is similar to the embodiment of FIG. 2, except cut-outs 71 shaped complementally to the cross-sectional shape of the beam are made in the opposite inner side wall panels 27, forming recesses into which the opposite ends of an elongated beam 72 are inserted. Thus, in this form of the invention the beam is located and held in place both by the engagement of its opposite ends in the recesses, and by the adhesive attachment of the flaps to the top surfaces of the beam.

Figure 8:
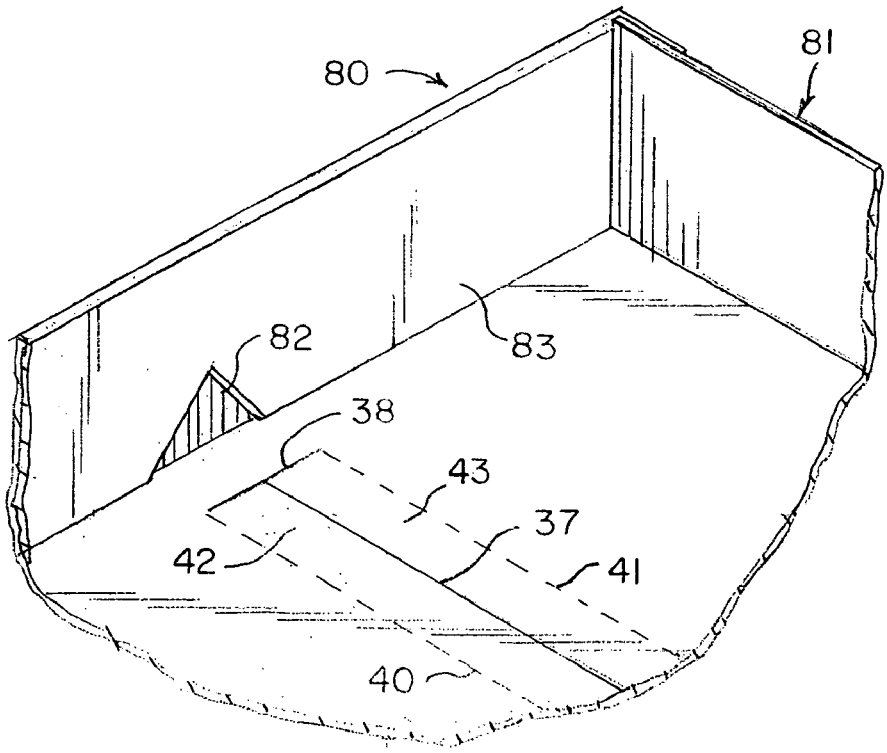
FIG. 8 is an enlarged fragmentary top perspective view of a third embodiment of the invention wherein the container is of single wall construction and crushed areas are formed in the inwardly facing surfaces of the side walls to form recesses for receiving the ends of the cross beam.

A third embodiment is shown at 80 in FIG. 8. In this embodiment, the container 81 is of simplified construction similar to the container shown in FIG. 1, but has the cuts 37, 38, and 39 (only some of which are shown) and scores 40 and 41, forming flaps 42 and 43 for adhesively attaching a cross beam (not shown) similarly to the FIG. 2 embodiment. In addition, crushed areas 82 are made in the inner facing surfaces of the opposite side walls 83, forming recesses into which the opposite ends of the beam (not shown) are inserted.

Figure 9:
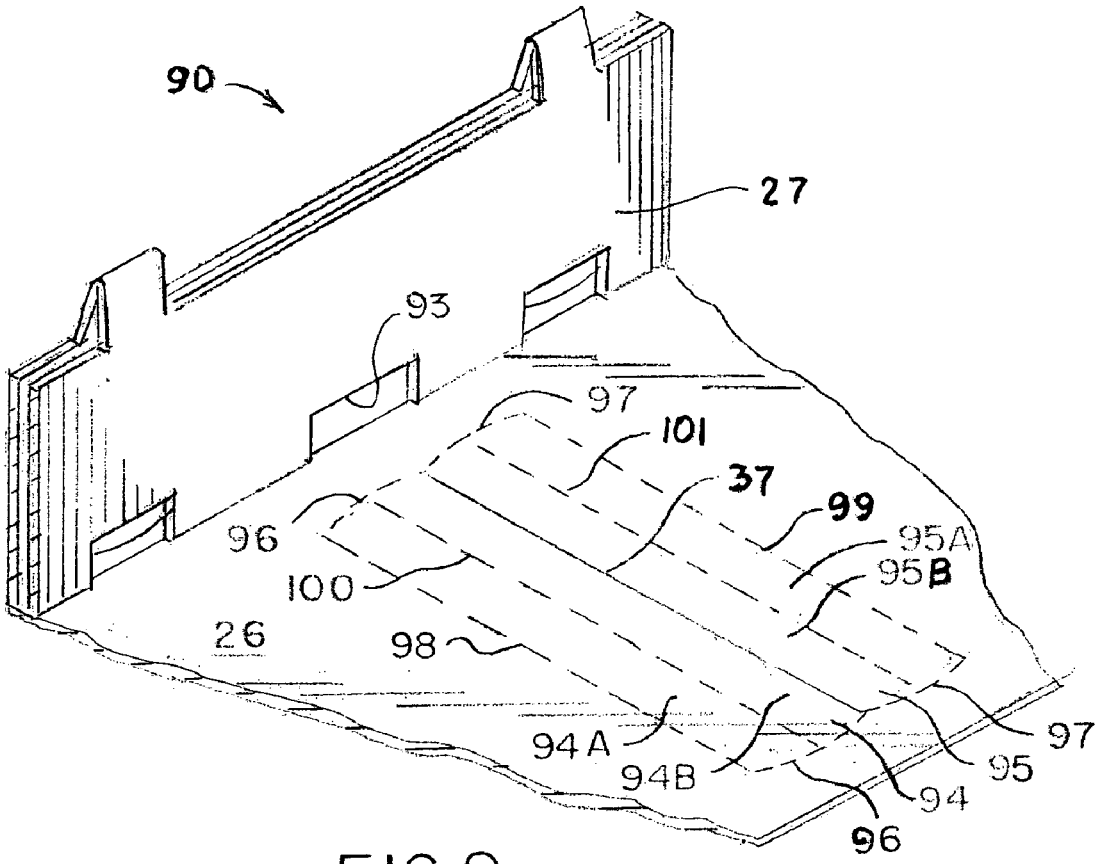
FIG. 9 is an enlarged fragmentary top perspective view of a fourth embodiment of the invention, prior to attachment of the cross beam, wherein the cross beam has rounded or straight edges and a flattened top surface.
Figure 10:
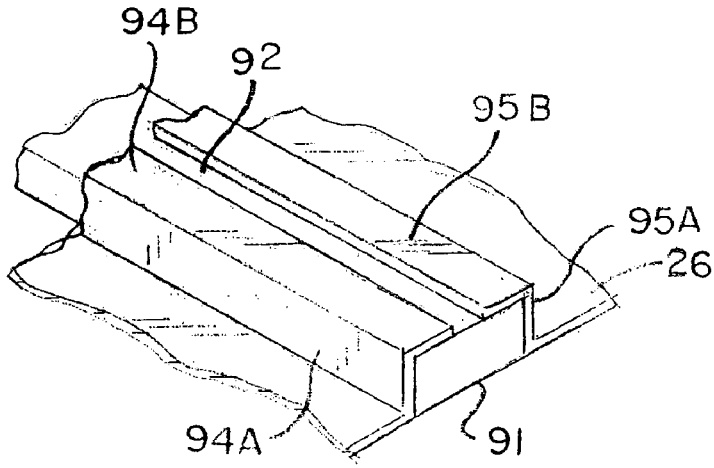
FIG. 10 is a further enlarged fragmentary top perspective view of a portion of the bottom wall of the container of FIG. 9, showing how the flaps are folded up and bent to overlie the opposite top surfaces of the cross beam in an erected container.

A fourth embodiment is shown at 90 in FIGS. 9 and 10. In this embodiment, the container is similar to the container of FIG. 2, but cross beam 91 is generally rectangular in transverse cross-sectional shape, with a flat top surface 92 extending generally parallel to the plane of the bottom wall 26. Cut-outs 93 shaped complementally to the cross-sectional shape of the beam are made in the opposite inner side wall panels 27 for receiving the ends of the cross beam, and modified flaps 94 and 95 are formed in the bottom wall for adhesive attachment to the beam. The flaps are defined by elongate transverse cut 37 and arched cuts 96 and 97 extending generally perpendicularly to each of the opposite ends of the cut 37, and longitudinally extending scores 98 and 99 extending between the outer ends of the arched cuts at opposite ends of the cut 37. It should be noted that the cuts do not necessarily have to be arched, such as for example they may be straight. Additional scores 100 and 101 extend longitudinally of each flap, bisecting it into first and second flap panels 94A, 94B and 95A, 95B, respectively. In use, the flaps are folded as shown in FIG. 10, with the second flap panels 94B, 95B overlying opposite edge portions of the top surface 92 of the beam to adhesively attach the beam to the bottom wall of the container.

Figure 11:
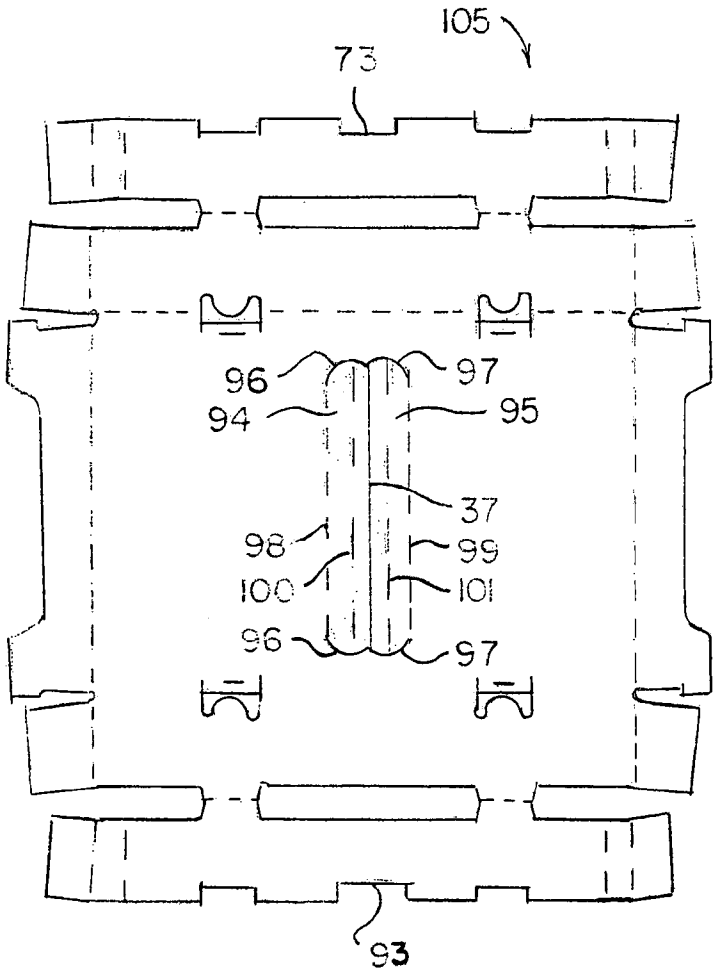
FIG. 11 is a top plan view of a blank for making the container of FIGS. 9 and 10.

A blank for making the container of FIGS. 9 and 10 is indicated generally at 105 in FIG. 11. The blank is substantially the same as the blank 50 in FIG. 6, except for the different flaps 94 and 95 formed by the cuts 37, 96 and 97 and the scores 98, 99, 100 and 101, and the shaped cut-outs 93 in the inner side wall panels.

Figure 12:
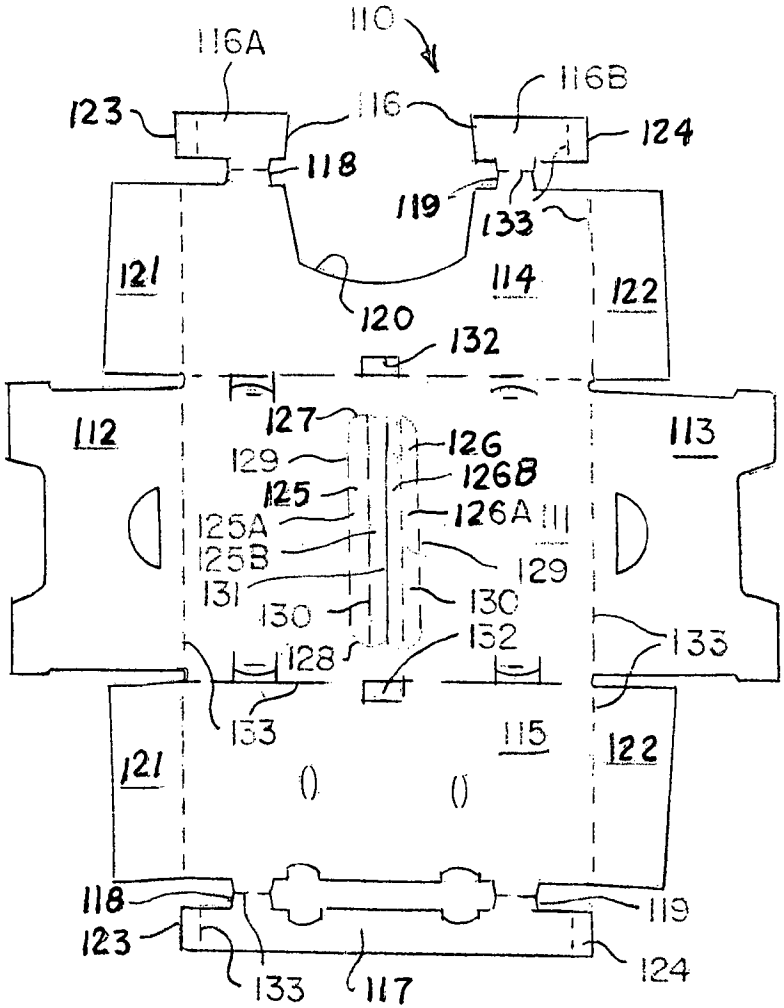
FIG. 12 is a top plan view of a blank for making a fifth embodiment of a container according to the invention, wherein the side and end walls have a substantial height, the inner side walls panels do not extend downwardly the full height of the side wall, and crushed areas are formed in the inwardly facing surface of the outer side wall panels to form recesses for receiving and locating the ends of the cross beam.

FIG. 12 depicts a blank 110 for making a fifth embodiment of the container of the invention. The blank comprises an elongate, rectangularly shaped central panel 111 that forms the bottom wall 26 in an erected container, opposite end panels 112 and 113 that form the end walls, first side panels 114 and 115 that form the outer side wall panels in an erected container, and second side panels 116 and 117 that form the inner side wall panels in an erected container. The end panels 112 and 113 and first side wall panels 114 and 115 are of considerably greater width than the end panels and first side panels in the previously described forms of the invention, whereby a container erected from this blank has a greater height than the previously described containers. The second side panels 116 and 117 have a much narrower width than the panels 114 and 115 and are foldably connected to the panels 114 and 115 by webs 118 and 119 that form stacking tabs when the second side panels are folded inwardly over the first side panels in an erected container to form container side walls. Further, a large cut-out 120 is made through the second side panel 116 and a substantial distance into the adjoining first side panel 114, separating the second side panel into two panel segments 116A and 116B. Extensions 121 and 122 on opposite ends of the first side panels form glue flaps for adhesive attachment to the outer surface of adjacent sides of the end panels in an erected container, and extensions 123 and 124 on outer ends of the second side panel segments 116A and 116B form diagonal corner panels in an erected container. Flaps 125 and 126 similar to the flaps 94 and 95 in the FIG. 11 embodiment are formed in the central bottom-forming panel 111. The flaps 125 and 126 differ from flaps 94 and 95 primarily in that elongate cuts 127 and 128 extend longitudinally inwardly along the flaps from approximately the center of the score line 129 and 130 at opposite ends of the center cut 141, defining lines along which the flaps can be folded to form first and second flap panels 125A, 125B and 126A, 126B. Crushed areas 132 are made in the edge of each first side wall panel adjacent the central panel, defining recesses into which the opposite ends of a cross beam can be inserted in an erected container. The respective panels and flaps are foldably joined to one another by suitable scores 133 between adjoining panels and flaps.

Figure 13:
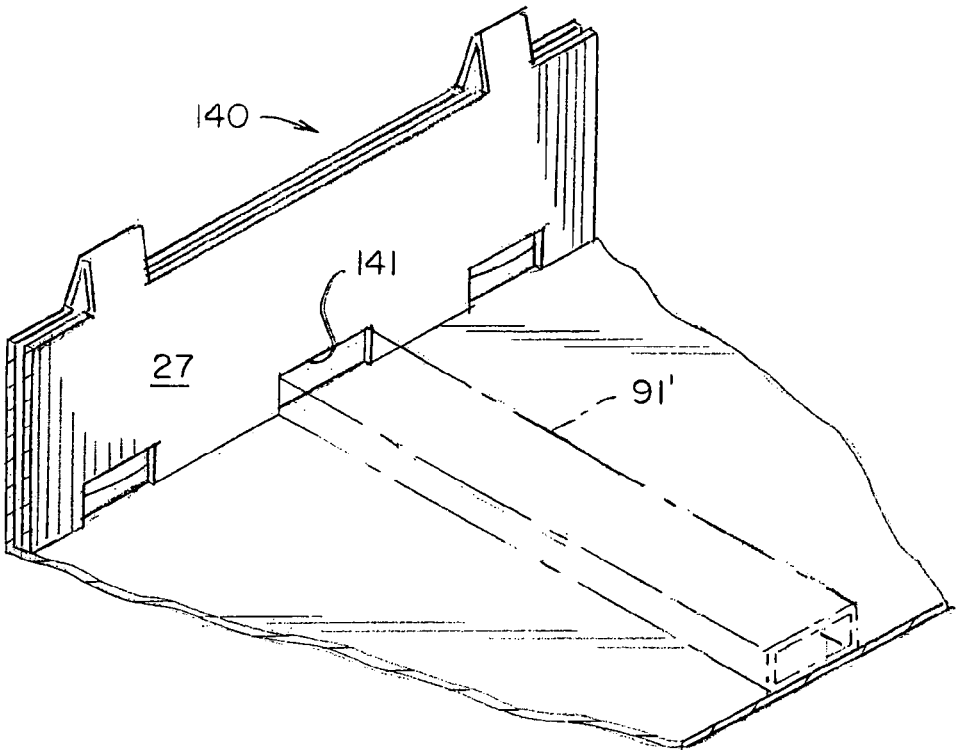
FIG. 13 is an enlarged fragmentary top perspective view of a sixth embodiment of the invention, wherein the bottom cross-beam-holding flaps are omitted and the beam is located and held in place by cut-outs in the opposite inner side wall panels of a double wall container construction.

A sixth embodiment of the invention is shown at 140 in FIG. 13. This embodiment is similar to the embodiment shown in FIGS. 9 and 10, except the flaps in the bottom are omitted, and the beam 91 is located and held in place by inserting the opposite ends into cut-outs 141 made in a lower edge of each of the inner side wall panels 27.

Figure 14:
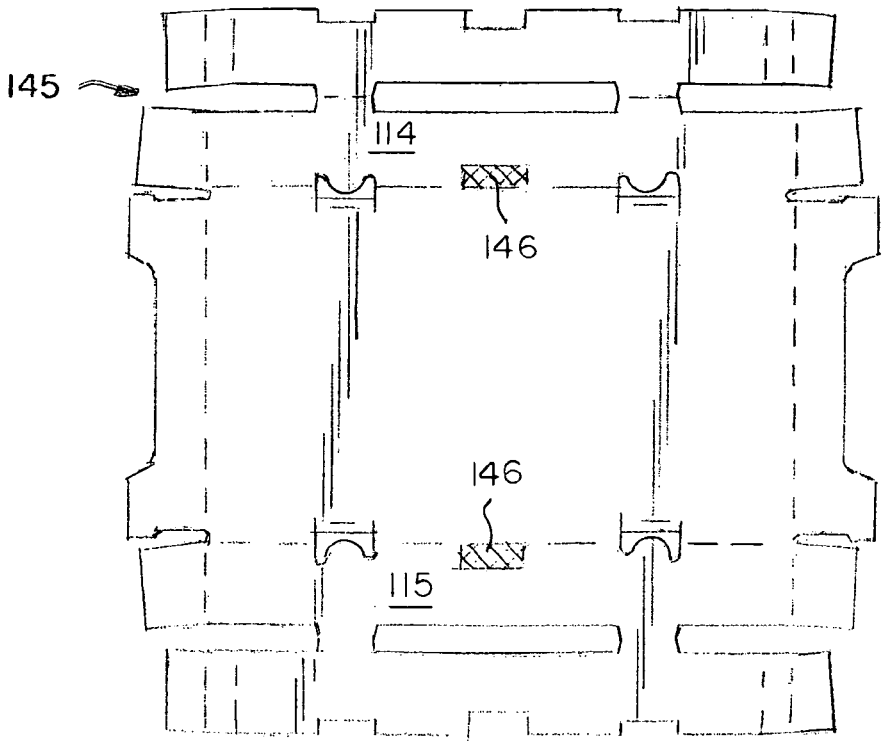
FIG. 14 is a top plan view of a blank for making the container of FIG. 13, wherein in addition to the cut-outs in the inner side wall panel, aligned crushed areas are formed in the inwardly facing surface of the outer side wall panel.

A blank for making the container of FIG. 13 is indicated generally at 145 in FIG. 14. This blank is substantially identical to the blank shown in FIG. 11, except that the flaps are omitted from the bottom, and crushed areas 146 are formed in a bottom edge of each first side wall panel 114 and 115 for locating and securing the beam (not shown) in place.

Figure 15:
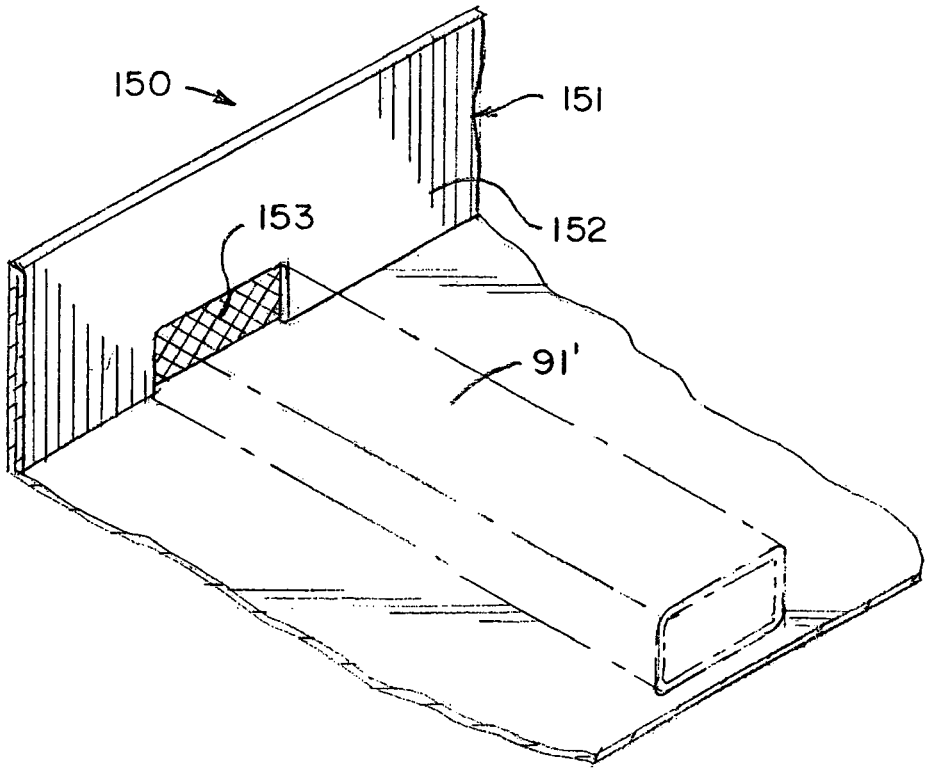
FIG. 15 is an enlarged fragmentary top perspective view of a seventh embodiment of the invention, wherein the bottom cross-beam-holding flaps are omitted and the beam is located and held in place by recesses formed by crushing areas in the inwardly facing surface of the side walls of a single wall container construction.

A seventh embodiment is shown at 150 in FIG. 15, wherein the container 151 is of basic construction similar to that shown in FIG. 1, with a side wall 152 of single thickness, and a crushed area 153 is formed in a lower edge of each side wall for receiving the opposite ends of the beam 91' to locate it and hold it in place.

Figure 16:
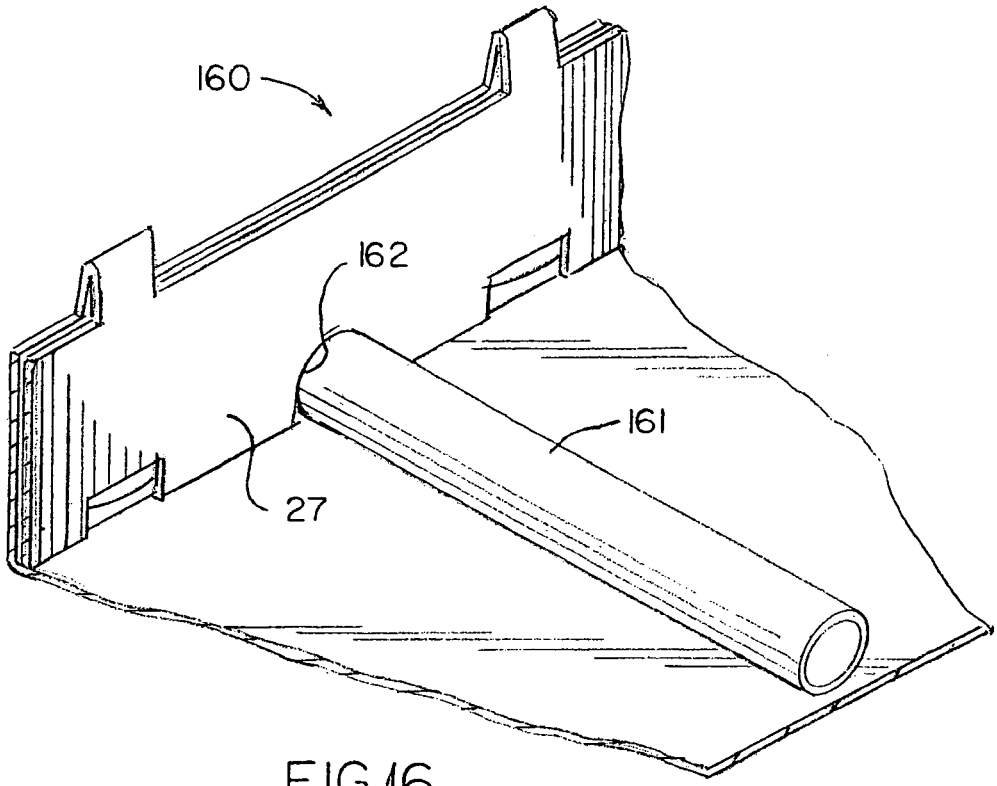
FIG. 16 is an enlarged fragmentary top perspective view similar to FIG. 13 of an eighth embodiment of the invention, wherein the cross beam is circular in transverse cross section.

An eighth embodiment is shown at 160 in FIG. 16, and is identical to the embodiment shown in FIG. 13, except that the beam 161 is circular in transverse cross-section, and the cut-outs 162 in the bottom edge of the inner side wall panels 27 are complementally shaped to fit the round configuration of the beam.

The various blanks illustrated and described herein are scored for the purpose of folding into a container suitable for holding, shipping or stacking a wide variety of objects, such as perishable agricultural products. The blank can be made of any known material that is suitable for shipping and transporting a wide variety of food items, and preferably is a flat corrugated paper or paperboard. The strength of the container can be made greater by constructing the container from more than one ply of paperboard (multi-ply paperboard). Further, although not specifically described herein, the blanks are provided with openings to provide breathing holes, and access for conventional automated machinery to manipulate and fold the blank into a fully erected container in a continuous in-line process.

The crushed areas are portions of the blank that are compressed, resulting in a paperboard thickness less than the non-crushed portions of the paperboard, thereby forming a recess.

The glue flaps and end walls may be adhered together with any adhesive known in the art for adhering panels of corrugated paper. Further, in several of the embodiments, as a result of the combination of the end walls and the glue flaps, the erected container has three layers in the corners, improving the stacking strength of the container.

In embodiments where the container blank has only a die cut recess on the interior panel, the erected container will only have a partial recess, that is to say, a recess on the inner portion of the side wall that does not extend entirely through the thickness of the side wall. In embodiments where, in addition, the outer side panels of the container blank have crushed areas, the recess has a greater depth.

The width dimensions of the beams preferably are slightly less than that of the recesses in the container walls to ensure a snug, non-bonded fit. The exact shape and width of the beam can vary greatly while maintaining the spirit of the invention. Further, the beam can be made of any material known in the art, such as wood, wound paper posts, plastic, metal or a composite material, that is suitable for being placed across a container to support product placed loosely in the container.

Further, although only a single centrally located beam has been specifically illustrated and described herein, more than one beam can be employed, or the beam can be placed closer to one end wall or the other, or extended between the end walls, or extended at an angle other than 90° to the side or end walls, while maintaining at least some of the functionality of the invention.

While the preferred embodiments of the invention have been illustrated and described, it will be appreciated that various changes can be made without departing from the spirit and scope of the invention as defined by the appended claims.

What is claimed is;

1. In a container having a bottom wall and side walls and adapted for storing and shipping loose products, such as agricultural produce, poultry, and the like, which tend to pool or concentrate in a central portion of the bottom of the container, causing sagging of the container bottom, the improvement comprising;

a bottom-reinforcing cross beam extending across the bottom wall to form a support bridge beneath loose product placed in the container to at least partially support the weight of the product and prevent sagging of the bottom wall, wherein said cross beam extends between opposing side walls and said opposing side walls include recessed areas into which opposite ends of the cross beam are inserted to position and hold the cross beam in place; and said recessed areas comprise crushed areas on an inner surface of said opposing side walls.

2. A container as claimed in claim 1, wherein said cross beam extends between opposing side walls across a central portion of the bottom wall.

3. A container as claimed in claim 1, wherein:

said recessed areas comprise cut-outs in said opposing side walls.

4. A container as claimed in claim 1, wherein:

a pair of oppositely folding opposed flaps are formed in said bottom wall; and said flaps are folded upwardly into the container and the cross beam is secured to an underside of said flaps.

5. A container as claimed in claim 1, wherein:

a pair of oppositely folding flaps having opposed free edges are formed in said bottom wall, with the opposed free edges in substantial alignment with said recessed areas; and said flaps are folded upwardly into the container and the cross beam is secured to an underside of said flaps, whereby said cross beam is positioned and held in place by said recessed areas and by said flaps.

6. A container as claimed in claim 5, wherein:

said recessed areas comprise cut-outs in said opposing side walls.

7. A container as claimed in claim 1, wherein:

said cross beam comprises at least one material selected from a group consisting of wood, corrugated paper, plastic, metal, paper wound posts, and a composite material.

8. A container as claimed in claim 1, wherein:

said cross beam comprises a hollow, tubular member.

9. A container as claimed in claim 4, wherein:

said cross beam comprises a hollow, tubular member having a substantially flat upper surface; and said opposed flaps are secured to said upper surface.

10. A container as claimed in claim 4, wherein:

said cross beam comprises a hollow, tubular member having a triangular cross-sectional shape with a substantially flat, horizontal bottom surface and oppositely downwardly divergent top surfaces; and said flaps are secured to said top surfaces, with said bottom surface being substantially coplanar with an outer bottom surface of said container.

11. A container as claimed in claim 9, wherein:

said beam is located between and secured to a pair of opposed flaps folded upwardly from said bottom wall into an interior of said container.

12. A container, comprising a bottom wall and a plurality of side walls that are adapted for storing and shipping loose products; and a bottom-reinforcing cross beam extending across the bottom wall to form a support bridge beneath loose products placed therein said container to at least partially support the weight of the product, wherein said cross beam extends between opposing side walls and said opposing side walls include recessed areas into which opposite ends of the cross beam are inserted to position and hold the cross beam in place;

a pair of oppositely folding flaps having opposed free edges are formed in said bottom wall, with the opposed free edges in substantial alignment with said recessed areas; and said flaps are folded upwardly into the container and the cross bean is secured to an underside of said flaps, whereby said cross beam is positioned and held in place by said recessed areas and by said flaps.

13. A container as claimed in claim 12, wherein said cross beam extends between opposing side walls across at least a portion of the bottom wall.

14. A container as claimed in claim 12, wherein said recessed areas comprise crushed areas on an inner surface of said opposing side walls.

15. A container as claimed in claim 12, wherein said recessed areas comprise cut-outs in said opposing side walls.

16. A container as claimed in claim 12, wherein a pair of oppositely folding opposed flaps are formed in said bottom wall; and said flaps are folded upwardly into the container and the cross beam is secured to an underside of said flaps.

17. A container as claimed in claim 16, wherein said cross beam comprises a hollow, tubular member having a substantially flat upper surface; and said opposed flaps are secured to said upper surface.

18. A container as claimed in claim 17, wherein said beam is located between and secured to a pair of opposed flaps folded upwardly from said bottom wall into an interior of said container.

19. A container as claimed in claim 16, wherein said cross beam comprises a hollow, tubular member having a triangular cross-sectional shape with a substantially flat, horizontal bottom surface and oppositely downwardly divergent top surfaces; and said flaps are secured to said top surfaces, with said bottom surface being substantially coplanar with an outer bottom surface of said container.

20. A container as claimed in claim 12, wherein said cross beam comprises at least one material selected from a group consisting of wood, corrugated paper, plastic, metal, paper wound posts, and a composite material.

21. A container as claimed in claim 12, wherein said cross beam comprises a hollow, tubular member.

22. A container, comprising a bottom wall and a plurality of side walls that are adapted for storing and shipping loose products; and a bottom-reinforcing cross beam extending across the bottom wall to form a support bridge beneath loose products placed therein said container to at least partially support the weight of the product, wherein a pair of oppositely folding opposed flaps are formed in said bottom wall; and said flaps are folded upwardly into the container and the cross beam is secured to an underside of said flaps.

23. A container as claimed in claim 22, wherein said cross beam extends between opposing side walls across at least a portion of the bottom wall.

24. A container as claimed in claim 22, wherein said opposing side walls include recessed areas into which opposite ends of the cross beam are inserted to position and hold the cross beam in place.

25. A container as claimed in claim 24, wherein said recessed areas comprise crushed areas on an inner surface of said opposing side walls.

26. A container as claimed in claim 24, wherein said recessed areas comprise cut-outs in said opposing side walls.

27. A container as claims in claim 24, wherein a pair of oppositely folding flaps having opposed free edges are formed in said bottom wall, with the opposed free edges in substantial alignment with said recessed areas; and said flaps are folded upwardly into the container and the cross beam is secured to an underside of said flaps, whereby said cross beam is positioned and held in place by said recessed areas and by said flaps.

28. A container as claimed in claim 27, wherein said recessed areas comprise cut-outs in said opposing side walls.

29. A container as claimed in claim 22, wherein said cross beam comprises at least one material selected from a group consisting of wood, corrugated paper, plastic, metal, paper wound posts, and a composite material.

30. A container as claimed in claim 22, wherein said cross beam comprises a hollow, tubular member.

31. A container as claimed in claim 22, wherein said cross beam comprises a hollow, tubular member having a substantially flat upper surface; and said opposed flaps are secured to said upper surface.

32. A container as claimed in claim 31, wherein said beam is located between and secured to a pair of opposed flaps folded upwardly from said bottom wall into an interior of said container.

33. A container as claimed in claim 31, wherein recessed areas are formed in a pair of opposing side walls, and opposite ends of said cross beam are engaged in said recessed areas to position and locate said cross beam.

34. A container as claimed in claim 22, wherein said cross beam comprises a hollow, tubular member having a triangular cross-sectional shape with a substantially flat, horizontal bottom surface and oppositely downwardly divergent top surfaces; and said flaps are secured to said top surfaces, with said bottom surface being substantially coplanar with an outer bottom sur6ce of said container.

* * * * *

UNITED STATES PATENT AND TRADEMARK OFFICE

CERTIFICATE OF CORRECTION

PATENT NO. : 7,413,111 B2
APPLICATION NO. : 10/867576
DATED : August 19, 2008
INVENTOR(S) : Benjamin W. Quaintance and Brian D. Smith It is certified that error appears in the above-identified patent and that said Letters Patent is hereby corrected as shown below:

Column 10, Claim 34 should be corrected as follows:

Claim 34. A container as claimed in claim 22, wherein said cross beam comprises a hollow, tubular member having a triangular cross-sectional shape with a substantially cross-sectional shape with a substantially flat, horizontal bottom surface and oppositely downwardly divergent top surfaces; and said flaps are secured to said top surfaces, with said bottom surface being substantially coplanar with an outer bottom surface of said container.

Signed and Sealed this

Sixth Day of January, 2009

JON W. DUDAS
*Director of the United States Patent and Trademark Office*

UNITED STATES PATENT AND TRADEMARK OFFICE

CERTIFICATE OF CORRECTION

PATENT NO. : 7,413,111 B2
APPLICATION NO. : 10/867576
DATED : August 19, 2008
INVENTOR(S) : Benjamin W. Quaintance and Brian D. Smith It is certified that error appears in the above-identified patent and that said Letters Patent is hereby corrected as shown below:

Column 10, Claim 34, lines 38-46, should be corrected as follows:

Claim 34. A container as claimed in claim 22, wherein said cross beam comprises a hollow, tubular member having a triangular cross-sectional shape with a substantially cross-sectional shape with a substantially flat, horizontal bottom surface and oppositely downwardly divergent top surfaces; and said flaps are secured to said top surfaces, with said bottom surface being substantially coplanar with an outer bottom surface of said container.

This certificate supersedes the Certificate of Correction issued January 6, 2009.

Signed and Sealed this

Third Day of February, 2009

John Doll

JOHN DOLL
*Acting Director of the United States Patent and Trademark Office*